US011571016B2

(12) United States Patent
Kittle, II

(10) Patent No.: US 11,571,016 B2
(45) Date of Patent: Feb. 7, 2023

(54) PISTON DEVICE FOR LOADING SMOKING MATERIAL INTO A TUBE

(71) Applicant: Thomas Allen Kittle, II, Glenwood, IA (US)

(72) Inventor: Thomas Allen Kittle, II, Glenwood, IA (US)

( * ) Notice: Subject to any disclaimer, the term of this patent is extended or adjusted under 35 U.S.C. 154(b) by 195 days.

(21) Appl. No.: 16/946,704

(22) Filed: Jul. 1, 2020

(65) Prior Publication Data

US 2021/0000165 A1 Jan. 7, 2021

Related U.S. Application Data

(60) Provisional application No. 62/871,010, filed on Jul. 5, 2019.

(51) Int. Cl.

| | |
|---|---|
| ***A24C 5/42*** | (2006.01) |
| ***A24C 5/00*** | (2020.01) |
| ***A24C 5/39*** | (2006.01) |

(52) U.S. Cl.

CPC ..... *A24C 5/42* (2013.01); *A24C 5/002* (2013.01); *A24C 5/39* (2013.01)

(58) Field of Classification Search

None

See application file for complete search history.

(56) References Cited

U.S. PATENT DOCUMENTS

| | | | | |
|---|---|---|---|---|
| 1,015,357 | A | 1/1912 | Straus | |
| 2,279,953 | A | 4/1942 | Richey | |
| 2,314,393 | A | 3/1943 | Dougherty | |
| 2,558,998 | A * | 7/1951 | Yearout | G01F 19/005 222/49 |
| 2,854,008 | A | 9/1958 | Vieman | |
| 4,501,283 | A | 2/1985 | Webb | |
| D284,795 | S | 7/1986 | Webb | |
| 4,620,551 | A | 11/1986 | Ruppert et al. | |
| 5,009,237 | A | 4/1991 | Schmidt et al. | |
| 2011/0114104 | A1* | 5/2011 | Demmer | A24C 5/40 131/281 |
| 2017/0319009 | A1 | 11/2017 | Seckel et al. | |

* cited by examiner

*Primary Examiner* — Phu H Nguyen

(74) *Attorney, Agent, or Firm* — Trenner Law Firm, LLC; Mark D. Trenner

(57) ABSTRACT

A piston device for loading material into a tube or other implement. In an example, the material is a smoking material loaded into a smoking implement. An example piston device includes a cylinder and a piston. The piston is removed from a first end of the cylinder and inserted into a second end of the cylinder. A cap slip locks onto the second end of the cylinder to provide a surface on which to compress the material against. Withdrawing the piston from the second end of the cylinder draws the smoking material into a chamber of the cylinder through an opening in the first end of the cylinder. Pressing the piston into the second end of the cylinder compresses the smoking material within the chamber of the cylinder, and then releases the smoking material from the chamber of the cylinder into the smoking implement.

20 Claims, 5 Drawing Sheets

PISTON DEVICE FOR LOADING SMOKING MATERIAL INTO A TUBE

PRIORITY CLAIM

This application claims the priority benefit of U.S. Provisional Patent Application No. 62/871,010 filed Jul. 5, 2019 titled "Piston Device For Loading Smoking Material Into A Tube" of Thomas Allen Kittle II, hereby incorporated by reference in its entirety as though fully set forth herein.

BACKGROUND

The art of rolling cigarettes has been around for a long time. This typically involves taking a smoking material and laying it on a paper, and then rolling the paper around the smoking material. The paper may have an adhesive to fasten the two ends together and form a tube around the smoking material, referred to as a cigarette. Preformed tubes are also available, in which the smoking material can simply be added (e.g., usually by scooping and/or pouring it from a tray or other instrument into the tube). However, none of these methods provide for an efficient and clean way to make cigarettes (joints, cigars, etc.).

DETAILED DESCRIPTION

Figure 1:
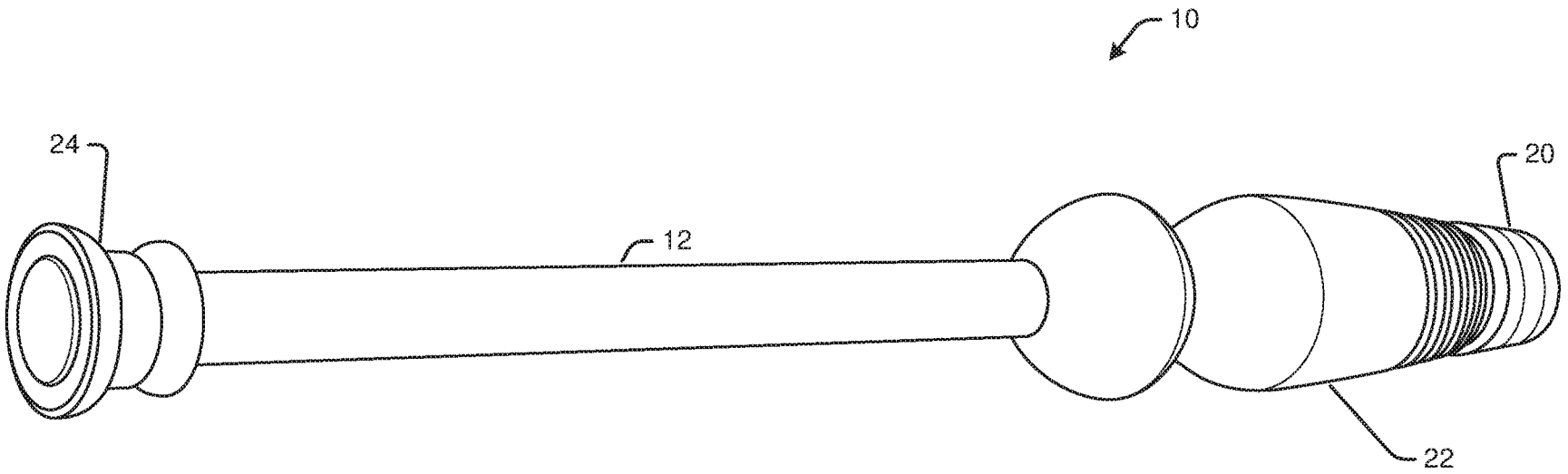
FIG. 1 is a perspective view of an example piston device for loading smoking material into a tube.

A piston device is disclosed for the clean collection and loading of a smoking material (e.g., pollen and/or fine plant particular suitable for smoking) into various shapes and sizes of paper and/or other tubes for smoking. It is noted that the device may be implemented for other purposes as well, such as but not limited to, loading a material into storage tubes and/or for other industries besides the smoking industry. However, the piston device is described herein for purposes of illustration as it may be implemented for loading smoking material into a tube to make cigarettes, joints, cigars, etc. for smoking.

An example of the device for loading smoking material into a tube includes a cylinder and a piston. The cylinder includes a handle and flexible shaft with an internal diameter slightly greater than the outer diameter of the piston. The piston, which may be solid, has an outer diameter slightly less than the inner diameter of the cylinder. One end of the cylinder may be flexible (e.g., to enhance picking up the smoking material), and the other end of the cylinder may be hard and thick to allow for compression of plant material within the cylinder.

The cylinder serves as both a collection chamber, and a compression chamber for the smoking material. That is, the piston and cylinder can be implemented to pick up smoking material by drawing the piston out of the cylinder. The piston can then be pressed into the cylinder to compress the smoking material within the cylinder before discharging the smoking material into the smoking tube. In an example, a cap is provided over the open end of the cylinder after drawing in the smoking material so that the smoking material can be pressed against the cap inside of the cylinder without needing to place the cylinder against a separate surface or tool during compression.

In an example, the device has a smooth bore shaft and piston. The piston is not attached to the cylinder. That is, the piston can be removed from one end of the cylinder and reinserted from the opposite side. The piston may be operated to draw smoking material into the cylinder, compress the smoking material within the cylinder, and discharge the compressed smoking material into a tube.

In an example, the piston has a wider end or flange to form a surface to pull the piston and draw smoking material into the cylinder, and then to press against by hand to compress and/or discharge the smoking material from the cylinder into the tube to form the cigarettes, joints, cigars, etc. for smoking.

In an example, the handle is designed to be thick, not only for providing a better grip, but also for strength and durability (e.g., during compression of the smoking material).

In an example, the collection tip (straw) of the cylinder may be flexible so that the tip can be pressed into corners of grinders, against the edge of trays, etc. to enhance collection of the smoking material to draw it into the cylinder without leaving much, if any, behind.

In an example, the device also includes a cap that can be closed over the cylinder end once the smoking material has been drawn into the cylinder. The cap provides a surface on which to compress the smoking material against within the cylinder, while also giving more strength to the handle.

Although the device can be implemented to load smoking material into cigarette papers and other smoking implements, the device may also be implemented for any number of other end-uses. Other examples include, but are not limited to, transferring pollen and fine plant material to/from storage containers and other vessels.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples shown and described are provided for purposes of illustration, and are not intended to be limiting. Other devices and/or device configurations may be utilized, as will be readily apparent to those having ordinary skill in the art after becoming familiar with the teachings herein.

Figure 2:
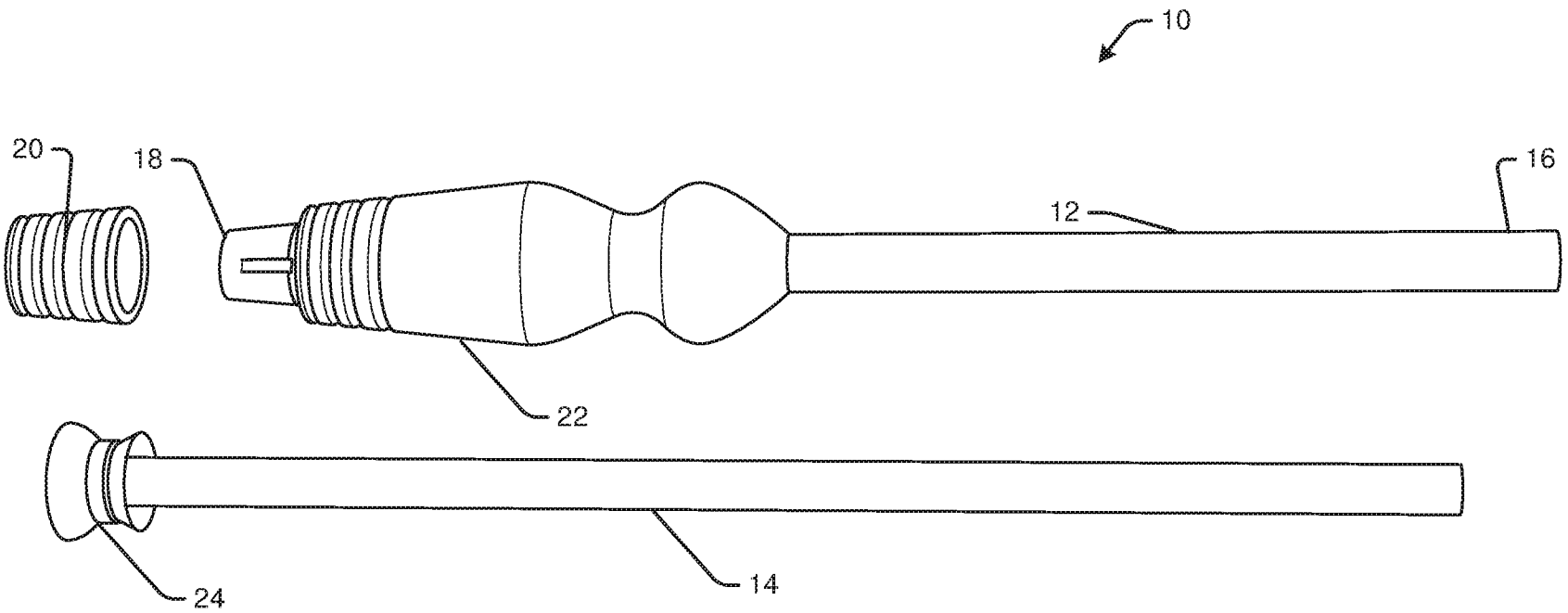
FIG. 2 shows components of the example piston device for loading smoking material into a tube.
Figure 5A:
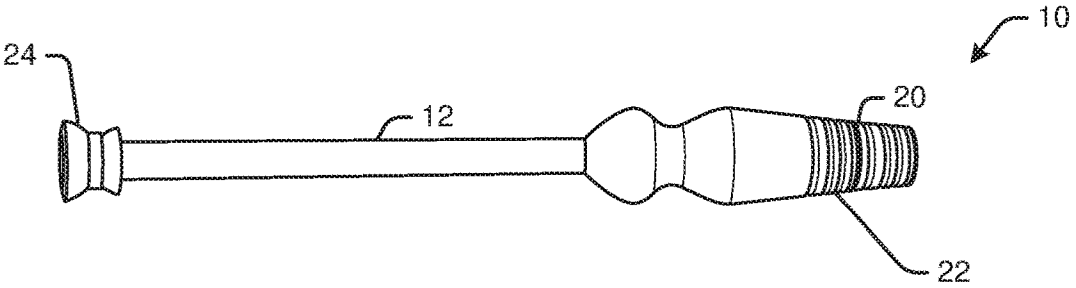
FIGS. 5A-C illustrate operations of the example piston device for loading smoking material into a tube.

FIG. 1 is a perspective view of an example piston device 10 for loading smoking material into a tube (not shown). FIG. 2 shows components of the example piston device 10 for loading smoking material into a tube. An example piston device 10 for loading smoking material into a tube includes a cylinder 12 and a plunger or piston 14. The piston 14 is configured to be positioned within the cylinder 12 in a stored configuration (e.g., as shown in FIG. 1 and FIG. 5A). The piston can be removed from a first end 16 of the cylinder when in the stored configuration, and then inserted into a second end 18 of the cylinder 12 for use in an operating configuration (e.g., as shown in FIG. 5C).

in an example, the cylinder 12 has an internal diameter which is larger than the outer diameter of the piston 14. In an example, one end of the cylinder 12 is hard and thick to form a handle portion 22. The smoking material may be compressed within the cylinder 12, e.g., by assembling the cap 20 and then pressing the piston 14 against the smoking material after it has been drawn into the cylinder 12, toward the end of the cylinder 12 having the cap 20.

in an example, a portion of the cylinder 12 (e.g., a tip portion toward the first end 16) is flexible to enable gathering smoking material (e.g., from the corners of a tray). The cylinder 12 may have a smooth bore shaft.

Withdrawing the solid piston 14 from the second end 18 of the cylinder 12 when in the operating configuration draws the smoking material into a chamber formed within the hollow cylinder 12 through an opening in the first end 16 of the cylinder 12. Optionally, a cap 20 may be positioned over the first end 16 of the cylinder 12 to compress the smoking material within the chamber of the cylinder 12 against the cap 20. After the smoking material is compressed, the cap 20 may be removed to discharge the smoking material from the chamber of the hollow cylinder 12.

Figure 3:
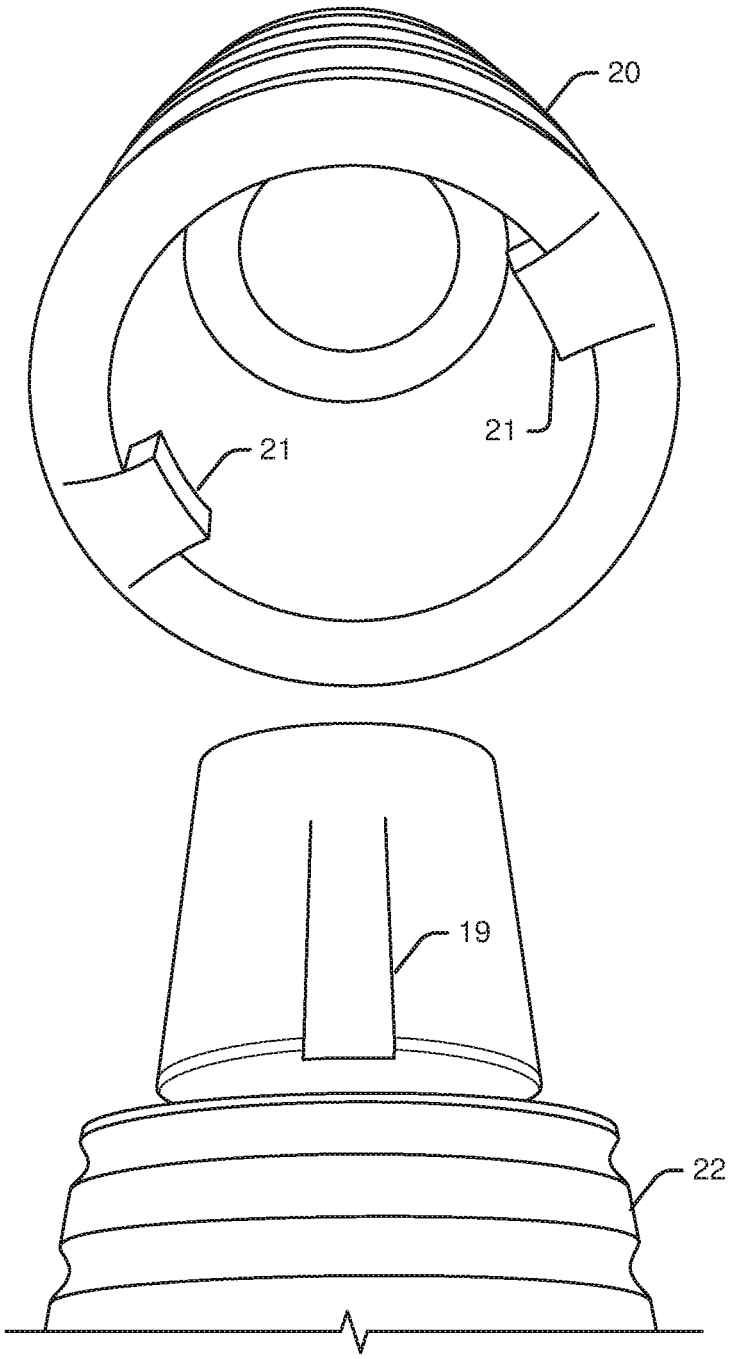
FIG. 3 is a close-up perspective view at a second end of the cylinder with a cap of the example piston device for loading smoking material into a tube.
Figure 4:
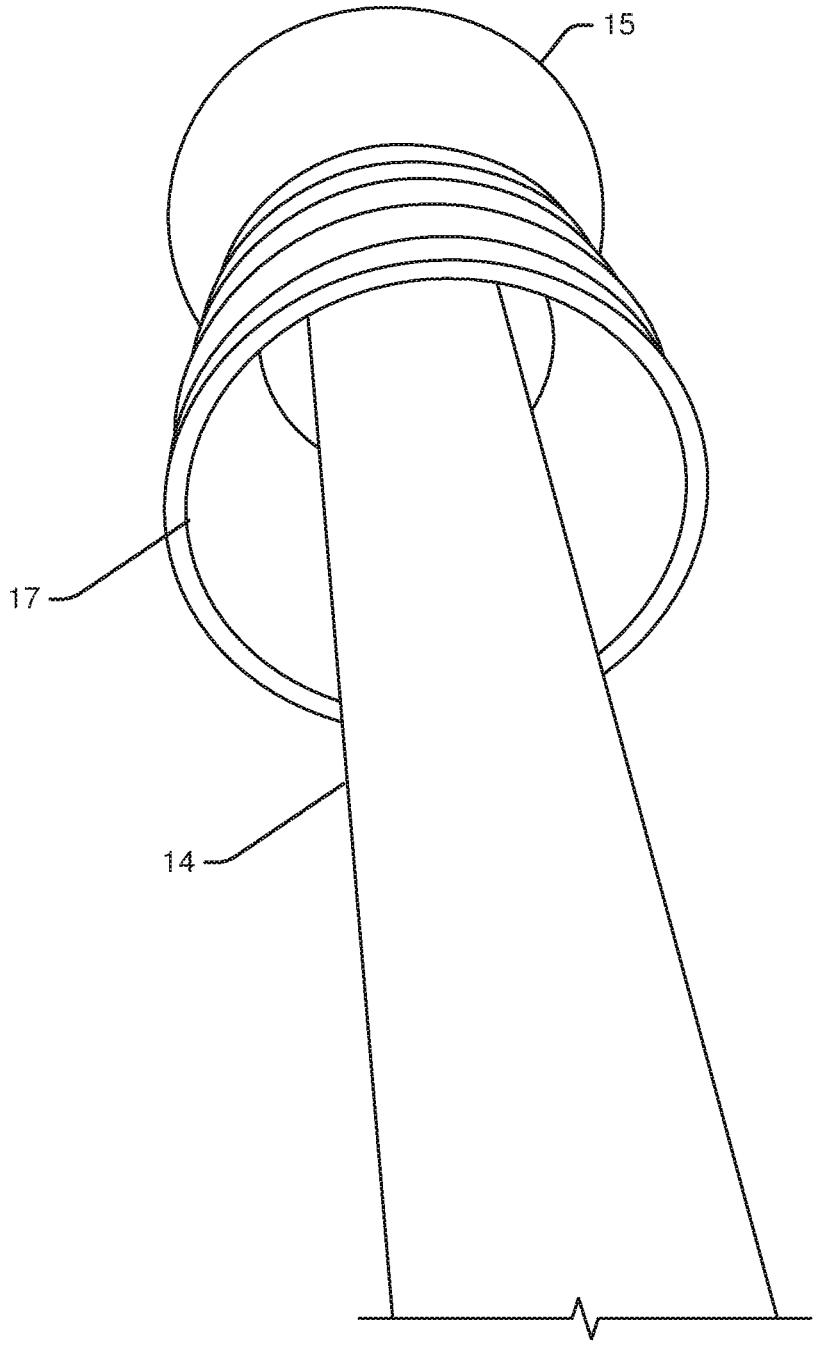
FIG. 4 is a close-up perspective view of a piston of the example piston device for loading smoking material into a tube.

FIG. 3 is a close-up perspective view at second end 20 of the cylinder 12 with cap 20 of the example piston device 10 for loading smoking material into a tube. FIG. 4 is a close-up perspective view of piston 14 of the example piston device 10 for loading smoking material into a tube.

In an example, the cap 20 for the second end 18 of the cylinder 12 slip locks onto the second end 18 of the cylinder 12. That is, notches 19 on opposite sides of the handle 22 receive a mating engagement 21 on the inside of the cap 20. As such, the cap 20 can slide onto the end of the handle 22. The cap 20 can then be rotated so that the mating engagement 21 does not line up with the notches 19, thereby locking the cap 20 onto the handle 22.

The cap 20 is not limited to such a design. In other examples, the cap 20 may press-fit or threadably engage with the handle 22. Other attachment mechanisms will also be applicable, as would be well understood by those having ordinary skill in the art after becoming familiar with the teachings herein.

In an example, the cap 20 provides several functions. The cap 20 closes the second 18 when not in use (e.g., when in a closed configuration). The cap 20 also can be attached to the first end 16 after plant material has been drawn into the cylinder 12. This provides a surface for the user to press the piston 14 against to compress the smoking material in the cylinder 14. The cap 20 may also provide additional strength for the handle of the cylinder 12.

In an example, the piston 14 is solid. The end 15 of the piston 14 may be solid (e.g., as shown in FIG. 1) or may be at least partially hollow 17 (as shown in FIG. 4). A hollow 17 portion of the piston 14 enables the end 15 to fit over the piston 14 and may also serve to secure the piston to the cylinder 12. The piston 14 has an outer diameter which is less than the inner diameter of the cylinder 12. The piston 14 has a wider end or flange 24 to aid in pressing the piston 14 through the cylinder 12.

Figure 5B:
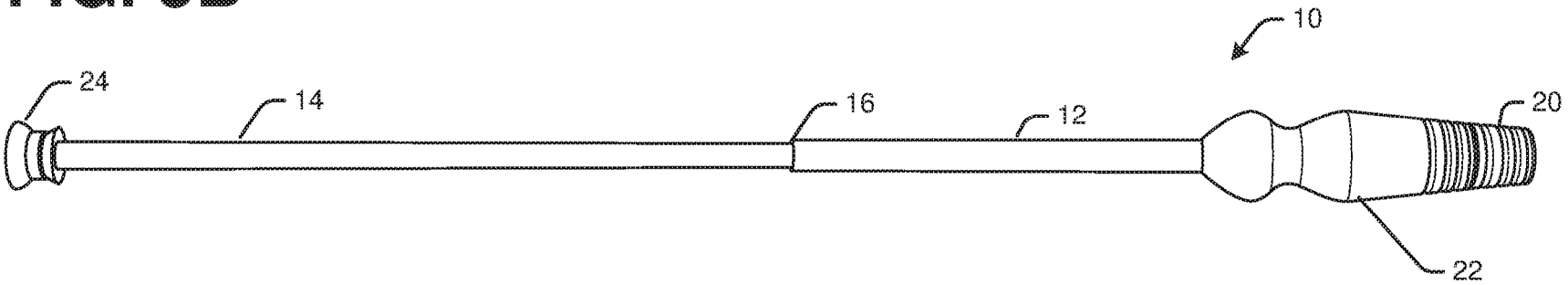
Figure 5C:
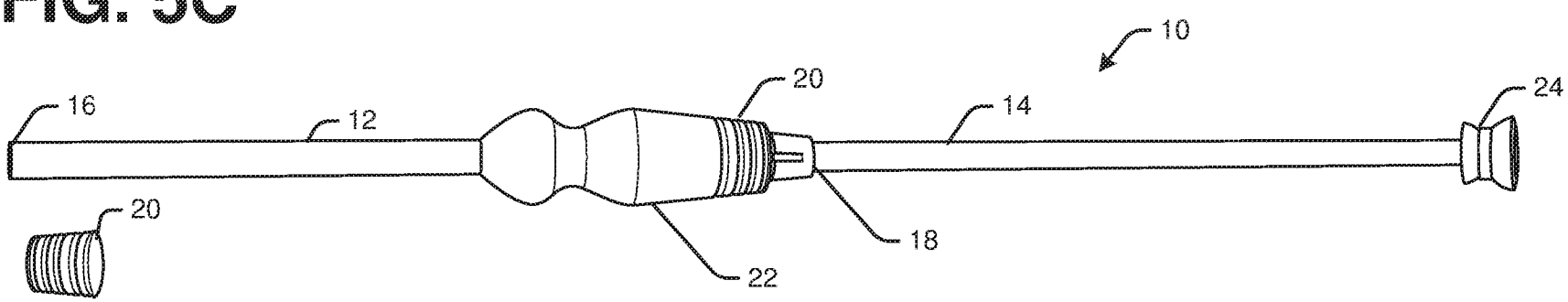

FIGS. 5A-C illustrate operations of the example piston device 10 for loading smoking material into a tube. During operation, the piston 14 is pulled out of the cylinder 12 when in the operating configuration to draw smoking material into the cylinder 12 through the first end 16. The cap 20 may be assembled and then the piston 14 pressed back against the smoking material, to compress the smoking material within the cylinder 12.

By way of illustration, withdrawing the solid piston 14 from the second end 18 of the cylinder 12 when in the operating configuration draws the smoking material into a chamber formed within the hollow cylinder 12 through an opening in the first end 16 of the cylinder 12. Optionally, the cap 20 may be positioned over (e.g., held, screwed onto, press-fit onto, etc.) the first end 16 of the cylinder 12 (or the first end 16 may be otherwise closed, even if by a finger of the operator). Then pressing the piston 14 into the second end 18 of the cylinder 12 compresses the smoking material within the chamber of the cylinder 12 against the cap 20. After the smoking material is compressed, the cap 20 may be removed from the first end 16 of the cylinder 12. In FIG. 5C, the cap 20 is shown adjacent the end 16 of the cylinder 12 as it may have just been removed from the end 16. Then pressing the piston 14 into the cylinder 12 releases the smoking material from the chamber of the hollow cylinder 12 and into the smoking implement (e.g., a tube held or fastened at the first end 16 of the cylinder 12).

This process of drawing in smoking material and compressing it may be repeated until the desired amount of smoking material has been gathered and compressed. The cap 20 may then be removed, and the piston 14 pressed back into the second end of the cylinder to release the smoking material from the cylinder 12 and into a tube, other smoking implement, or elsewhere (e.g., even back onto a tray).

The operations shown and described herein are provided to illustrate example implementations. It is noted that the operations are not limited to the ordering shown. Still other operations may also be implemented.

The ends of the cylinder 14 are described as first and second end herein for reference in an operating example, and are not intended to be limiting. In addition, other examples are also contemplated wherein the piston 14 and cap 20 may be provided on either end of the cylinder 20 to accomplish the loading and compressing of smoking material, prior to discharging it.

It is noted that the examples shown and described are provided for purposes of illustration and are not intended to be limiting. Still other examples are also contemplated.

The invention claimed is:

1. A piston device, comprising:

a cylinder with an inner wall portion for receiving a material, the inner wall portion defined as a continuous length of the cylinder having a substantially constant inner diameter; and a piston with a handle portion and an outer wall portion, the outer wall portion defined as a continuous length of the piston having a substantially constant outer diameter, the outer wall portion of the piston sliding in contact with the inner wall portion of the cylinder, the piston configured to be slid into a first end of the cylinder for storing the piston in a stored configuration, the piston removed from the first end of the cylinder and slid into a second end of the cylinder for operating the piston in an operating configuration;

wherein withdrawing the piston from the second end of the cylinder when in the operating configuration the material is received into the cylinder through an opening in the first end of the cylinder, and wherein pressing the piston into the second end of the cylinder compresses the material within the cylinder, and then releases the material from the cylinder.

2. The piston device of claim 1, wherein the material is a smoking material, and the compressed smoking material is released from the cylinder into a tube or other smoking implement.

3. The piston device of claim 1, wherein the cylinder has a flexible portion to enhance pickup of the material.

4. The piston device of claim 1, wherein the cylinder has a smooth bore shaft.

5. The piston device of claim 1, wherein the cylinder has an internal diameter which is larger than the outer diameter of the piston.

6. The piston device of claim 1, wherein the piston has an outer diameter which is less than the inner diameter of the cylinder.

7. The piston device of claim 1, wherein the piston is solid.

8. The piston device of claim 1, wherein the piston has a flanged end to aid in pressing the piston through the cylinder.

9. The piston device of claim 1, wherein at least one end of the cylinder is configured to compress the smoking material.

10. The piston device of claim 1, further comprising a cap for the second end of the cylinder.

11. The piston device of claim 1, wherein the cap slip locks onto the second end of the cylinder.

12. The piston device of claim 1, wherein the cap provides a surface internal to the cylinder on which to compress the material in the cylinder against by operation of the piston.

13. The piston device of claim 1, wherein the cap provides strength to a handle of the cylinder.

14. A piston device for loading smoking material into a smoking implement, comprising:

a hollow cylinder with an inner wall portion for receiving a material, the inner wall portion defined as a continuous length of the cylinder having a substantially constant inner diameter; and a solid piston with a handle portion and an outer wall portion, the outer wall portion defined as a continuous length of the piston having a substantially constant outer diameter, the outer wall portion of the piston sliding in contact with the inner wall portion of the cylinder, the piston configured to be positioned within the hollow cylinder in a stored configuration, the solid piston removed from a first end of the hollow cylinder when in the stored configuration and inserted into a second end of the hollow cylinder in an operating configuration;

wherein withdrawing the solid piston from the second end of the hollow cylinder when in the operating configuration the smoking material is received into a chamber of the hollow cylinder through an opening in the first end of the hollow cylinder, and wherein pressing the solid piston into the second end of the hollow cylinder compresses the smoking material within the chamber of the hollow cylinder, and then releases the smoking material from the chamber of the hollow cylinder into the smoking implement.

15. The piston device of claim 14, wherein the hollow cylinder has a flexible portion to enhance pickup of the material.

16. The piston device of claim 14, wherein the hollow cylinder has a smooth bore shaft with an internal diameter which is larger than the outer diameter of the solid piston, and wherein the solid piston has an outer diameter which is less than the inner diameter of the hollow cylinder.

17. The piston device of claim 14, further comprising a cap for the second end of the hollow cylinder, wherein the cap slip locks onto the second end of the hollow cylinder to provide a surface internal to the hollow cylinder on which to compress the material in the hollow cylinder against by operation of the solid piston.

18. A piston device for loading smoking material into a smoking implement, comprising:

a hollow cylinder with an inner wall portion for receiving a smoking material, the inner wall portion defined as a continuous length of the cylinder having a substantially constant inner diameter;

a solid piston with a handle portion and an outer wall portion, the outer wall portion defined as a continuous length of the piston having a substantially constant outer diameter, the outer wall portion of the piston sliding in contact with the inner wall portion of the cylinder, the piston configured to be positioned within the hollow cylinder in a stored configuration, the solid piston removed from a first end of the hollow cylinder when in the stored configuration and inserted into a second end of the hollow cylinder in an operating configuration; and a cap for the second end of the hollow cylinder, wherein the cap slip locks onto the second end of the hollow cylinder to provide a surface internal to the hollow cylinder on which to compress the material in the hollow cylinder against by operation of the solid piston;

wherein withdrawing the solid piston from the second end of the hollow cylinder when in the operating configuration the smoking material is received into a chamber of the hollow cylinder through an opening in the first end of the hollow cylinder, and wherein pressing the solid piston into the second end of the hollow cylinder compresses the smoking material within the chamber of the hollow cylinder, and then releases the smoking material from the chamber of the hollow cylinder into the smoking implement.

19. The piston device of claim 18, wherein the hollow cylinder has a flexible portion to enhance pickup of the material.

20. The piston device of claim 18, wherein the hollow cylinder has a smooth bore shaft with an internal diameter which is larger than the outer diameter of the solid piston, and wherein the solid piston has an outer diameter which is less than the inner diameter of the hollow cylinder.

* * * * *